US010336082B2

(12) United States Patent
Kondo

(10) Patent No.: US 10,336,082 B2
(45) Date of Patent: Jul. 2, 2019

(54) PRINTING APPARATUS AND PRINTING METHOD INCLUDING PENETRATION LIQUID

(71) Applicant: SEIKO EPSON CORPORATION, Tokyo (JP)

(72) Inventor: Takamitsu Kondo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/799,493

(22) Filed: Oct. 31, 2017

(65) Prior Publication Data

US 2018/0126739 A1 May 10, 2018

(30) Foreign Application Priority Data

Nov. 4, 2016 (JP) ..... 2016-216697

(51) Int. Cl.

| | |
|---|---|
| ***B41J 2/21*** | (2006.01) |
| ***D06P 5/30*** | (2006.01) |
| ***B41J 11/00*** | (2006.01) |
| ***B41J 2/005*** | (2006.01) |
| ***B41J 2/045*** | (2006.01) |
| ***B41J 2/165*** | (2006.01) |
| ***B41J 2/175*** | (2006.01) |
| ***B41J 2/205*** | (2006.01) |
| ***B41J 3/407*** | (2006.01) |

(52) U.S. Cl.

CPC ..... *B41J 2/175* (2013.01); *B41J 2/0057* (2013.01); *B41J 2/04535* (2013.01); *B41J 2/16523* (2013.01); *B41J 2/2056* (2013.01); *B41J 2/2114* (2013.01); *B41J 3/4078* (2013.01); *D06P 5/30* (2013.01); *B41J 11/007* (2013.01)

(58) Field of Classification Search

CPC ..... B41J 2/175; B41J 2/0057; B41J 2/16423; B41J 2/2056; B41J 2/211; B41J 2/07

See application file for complete search history.

(56) References Cited

U.S. PATENT DOCUMENTS 6,471,347 B1 10/2002 Koitabashi
8,777,369 B2 * 7/2014 Aruga ..... B41J 3/4078 347/21

(Continued)

FOREIGN PATENT DOCUMENTS

| | | |
|---|---|---|
| JP | 2007106117 A | 4/2007 |
| JP | 2013-193303 | 9/2013 |
| JP | 2015-020408 | 2/2015 |

OTHER PUBLICATIONS

European Search Report issued in Application No. 17200003 dated Mar. 20, 2018.

*Primary Examiner* — Juanita D Jackson
(74) *Attorney, Agent, or Firm* — Workman Nydegger

(57) ABSTRACT

A printing apparatus including a discharge unit, a movement unit and an adjustment unit. The discharge unit discharges ink and penetration liquid onto one side of the recording medium. The penetration liquid promotes penetration of the ink into the other side of the recording medium. The movement unit moves the discharge unit and the recording medium relative to each other. The adjustment unit adjusts a discharge amount of the penetration liquid discharged from the discharge unit onto the recording medium based on at least a relative movement speed of the discharge unit to the recording medium.

8 Claims, 8 Drawing Sheets

(56) References Cited

U.S. PATENT DOCUMENTS

| | | | | |
|---|---|---|---|---|
| 2002/0158926 | A1 | 10/2002 | Fukano | |
| 2007/0064026 | A1 | 3/2007 | Hirakawa | |
| 2012/0182345 | A1 | 7/2012 | Ohtsuka | |
| 2014/0043393 | A1* | 2/2014 | Takeuchi | B41J 2/07 347/21 |
| 2014/0285588 | A1 | 9/2014 | Aruga et al. | |

* cited by examiner

PRINTING APPARATUS AND PRINTING METHOD INCLUDING PENETRATION LIQUID

BACKGROUND

1. Technical Field

The present invention relates to a printing apparatus and a printing method.

2. Related Art

An ink jet recording apparatus configured to perform printing on a print paper sheet as a recording medium is known (see, for example, JP-A-2015-20408). JP-A-2015-20408 discloses that ink to which a penetrant has been added is used to promote penetration of the ink into a print paper sheet. However, even when the ink to which the penetrant has been added is used, if, for example, the type of print paper sheet loaded in the ink jet recording apparatus is changed, the penetration of the ink into the print paper sheet may become insufficient. Thus, such an ink is unsuitable when the density on both sides of a print paper sheet is desired to be as equal as possible.

Moreover, there is known an ink jet recording apparatus configured to apply process liquid as a penetrant onto a recording medium separately from ink (see, for example, JP-A-2013-193303). According to the ink jet recording apparatus of JP-A-2013-193303, the ink and the process liquid are applied at different timings, and thus, the glossiness of the recording medium is overall uniform. However, when it is desirable that the density on both sides of a recording medium be as equal as possible, the ink jet recording apparatus described in JP-A-2013-193303 is unsuitable.

SUMMARY

An advantage of some embodiments is to provide a printing apparatus and a printing method which enable the difference in density between one side and the other side of a sheet-like recording medium after printing to be as small as possible.

Such an advantage can be achieved by the following invention.

A printing apparatus according to an embodiment is configured to perform printing on a sheet-like recording medium into which liquid can penetrate, the printing apparatus including: a discharge unit configured to discharge, onto one side of the recording medium, ink and penetration liquid which promotes penetration of the ink into the other side of the recording medium; a movement unit configured to move the discharge unit and the recording medium relative to each other when the printing is performed; and an adjustment unit configured to adjust a discharge amount of the penetration liquid discharged from the discharge unit onto the recording medium on the basis of at least a relative movement speed of the discharge unit to the recording medium.

Thus, the discharge amount of the penetration liquid is adjusted to enable the post-printing difference in density between one side and the other side of the recording medium to be as small as possible. Therefore, when the recording medium is processed into, for example, a scarf, the produced product is usable in a reversible manner.

It is preferable that in the printing apparatus, the recording medium has an elongated shape, and the movement unit includes a transport unit configured to transport the recording medium in a longitudinal direction of the recording medium, and a reciprocating movement unit configured to reciprocate the discharge unit in a direction crossing the direction in which the recording medium is transported.

This enables stable and rapid printing on the recording medium.

It is preferable that in the printing apparatus, the adjustment unit adjusts the discharge amount of the penetration liquid on the basis of a transport speed at which the recording medium is transported.

This enables an accurate and easy discharge amount adjustment of penetration liquid when the printing apparatus is configured to unidirectionally transport the recording medium relatively to the discharge unit.

In this case, the printing apparatus preferably includes a storage unit configured to store a first calibration curve representing a relationship between the transport speed and a difference in density between one side and the other side of the recording medium on which the printing has been performed and a second calibration curve representing a relationship of a mixing ratio of the ink and the penetration liquid when the printing was performed and the difference in density, wherein the adjustment unit adjusts the discharge amount of the penetration liquid by using the first calibration curve and the second calibration curve.

Thus, for example, when the printing apparatus is capable of performing color printing, the first calibration curve and the second calibration curve are prepared for each of ink colors, which enables an adjustment of the discharge amount of the penetration liquid to a discharge amount suitable for the ink color.

It is preferable that in the printing apparatus, the adjustment unit adjusts the discharge amount of the penetration liquid on the basis of a reciprocating movement speed at which the discharge unit reciprocates.

This enables an accurate and easy discharge amount adjustment of the penetration liquid when the discharge unit is configured to reciprocate unidirectionally relatively to the recording medium.

It is preferable that in the printing apparatus, the recording medium is a medium on which an image is formed by the printing, and the adjustment unit adjusts the discharge amount of the penetration liquid on the basis of a required number of times of reciprocation of the discharge unit to form the image.

This increases the number of conditions for adjustment of the discharge amount of the penetration liquid, and thus, it is possible to more accurately adjust the discharge amount of the penetration liquid.

It is preferable that in the printing apparatus, the adjustment unit changes the number of liquid droplets of the penetration liquid per unit area of the recording medium or a volume per liquid droplet of the penetration liquid to adjust the discharge amount of the penetration liquid.

Thus, aspects for adjusting the discharge amount of the penetration liquid by the discharge unit can be accordingly selected depending on, for example, the configuration of the discharge unit.

It is preferable that in the printing apparatus, the discharge unit includes a diaphragm, a cavity which is filled with the penetration liquid and in which pressure is increased and reduced by vibration of the diaphragm, a nozzle which is in communication with the cavity and through which the penetration liquid is discharged as liquid droplets by an increase and a decrease in the pressure in the cavity, wherein the adjustment unit changes the oscillation frequency of the diaphragm to vary the number of the liquid droplets of the penetration liquid and changes the amplitude of the diaphragm to vary the volume per liquid droplet of the penetration liquid.

Thus, a simple configuration that the oscillation frequency of the diaphragm is changed or that the amplitude of the diaphragm is changed enables easy adjustment of the discharge amount of the penetration liquid.

A printing method according to an embodiment includes performing printing on a sheet-like recording medium into which liquid can penetrate, wherein in the performing of the printing, a printing apparatus is used, the printing apparatus including a discharge unit configured to discharge, onto one side of the recording medium, ink and penetration liquid which promotes penetration of the ink into the other side of the recording medium; a movement unit configured to move the discharge unit and the recording medium relative to each other when the printing is performed; and an adjustment unit configured to adjust a discharge amount of the penetration liquid discharged from the discharge unit onto the recording medium on the basis of at least a relative movement speed of the discharge unit to the recording medium.

Thus, the discharge amount of the penetration liquid is adjusted to enable the difference in density between one side and the other side of the recording medium after printing to be as small as possible. Therefore, when the recording medium is processed into, for example, a scarf, the produced product is usable in a reversible manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printing apparatus and a printing method will be described in detail below with reference to embodiments shown in the attached drawings.

First Embodiment

Figure 1:
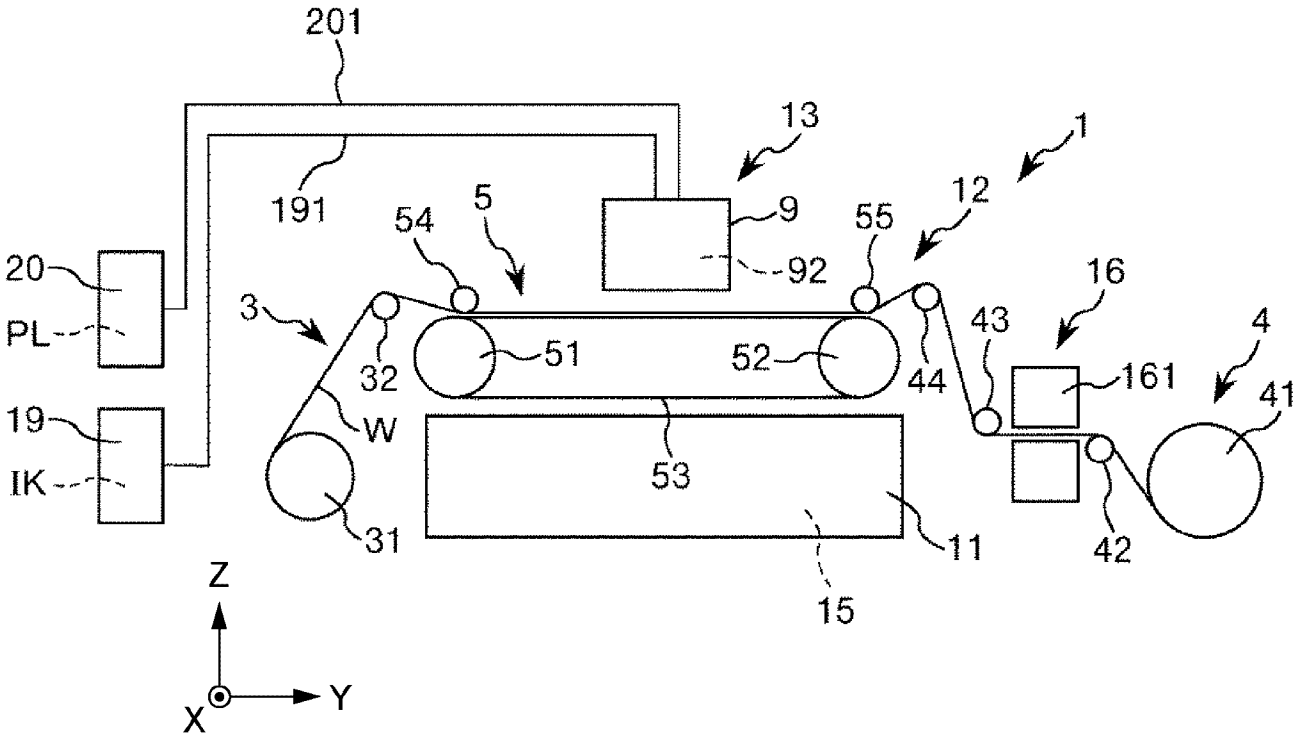
FIG. 1 is a side view schematically illustrating a printing apparatus of a first embodiment.
Figure 2:
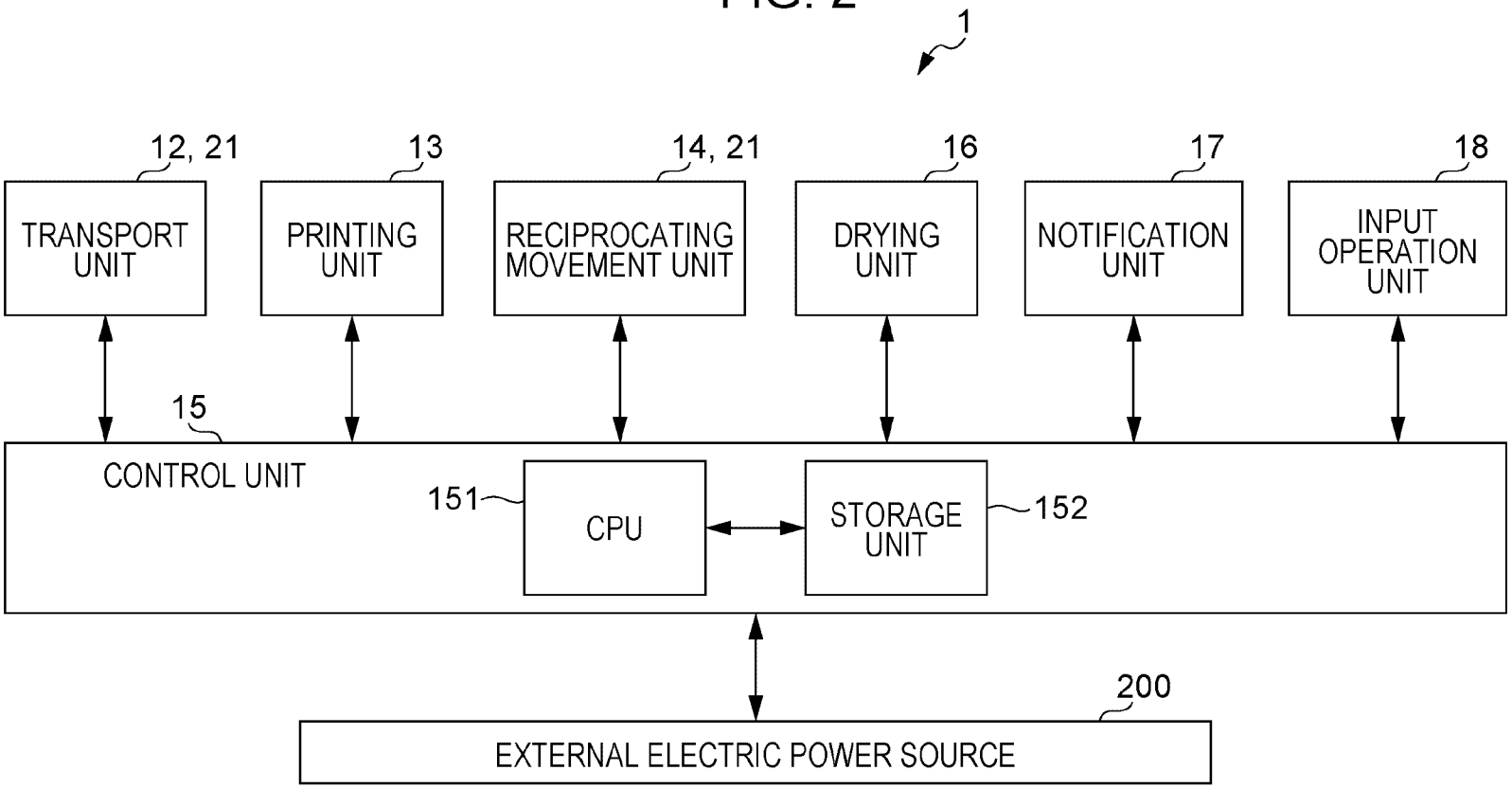
FIG. 2 is a block diagram illustrating a main part of the printing apparatus of FIG. 1.
Figure 3:
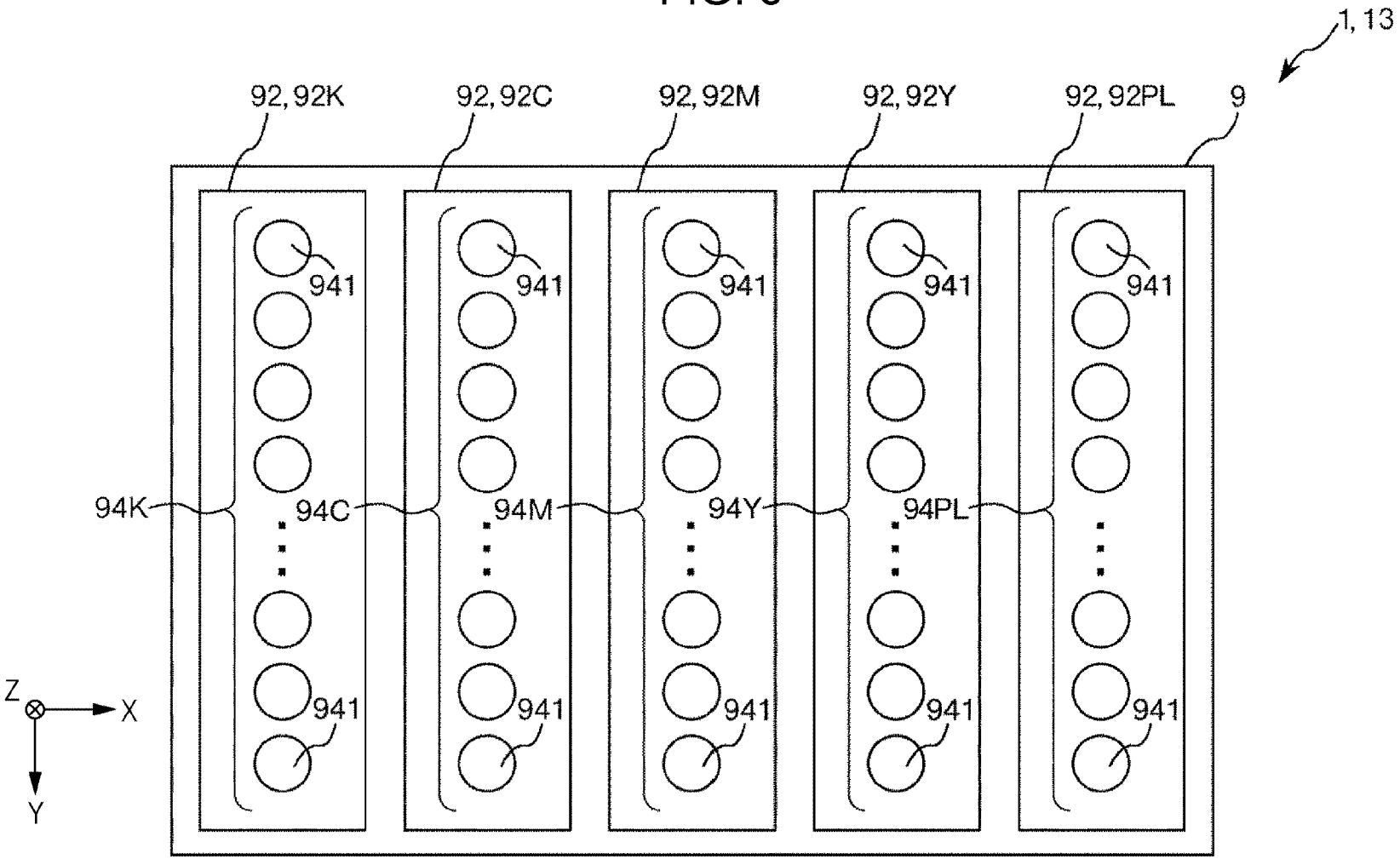
FIG. 3 is a view illustrating an ink jet head of the printing apparatus of FIG. 1 seen from below.
Figure 4:
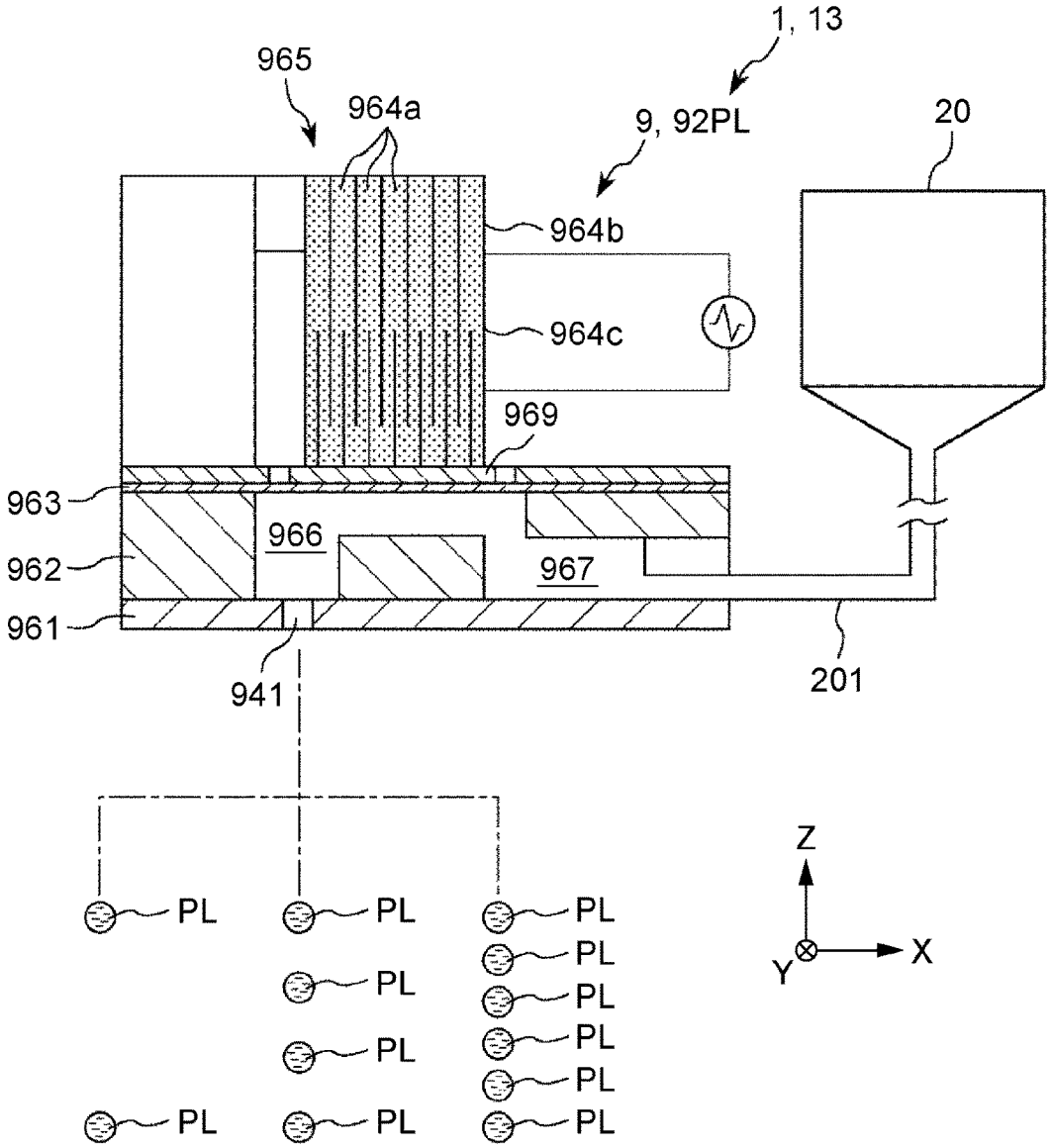
FIG. 4 is a vertical sectional view illustrating the ink jet head of the printing apparatus of FIG. 1.
Figure 5:
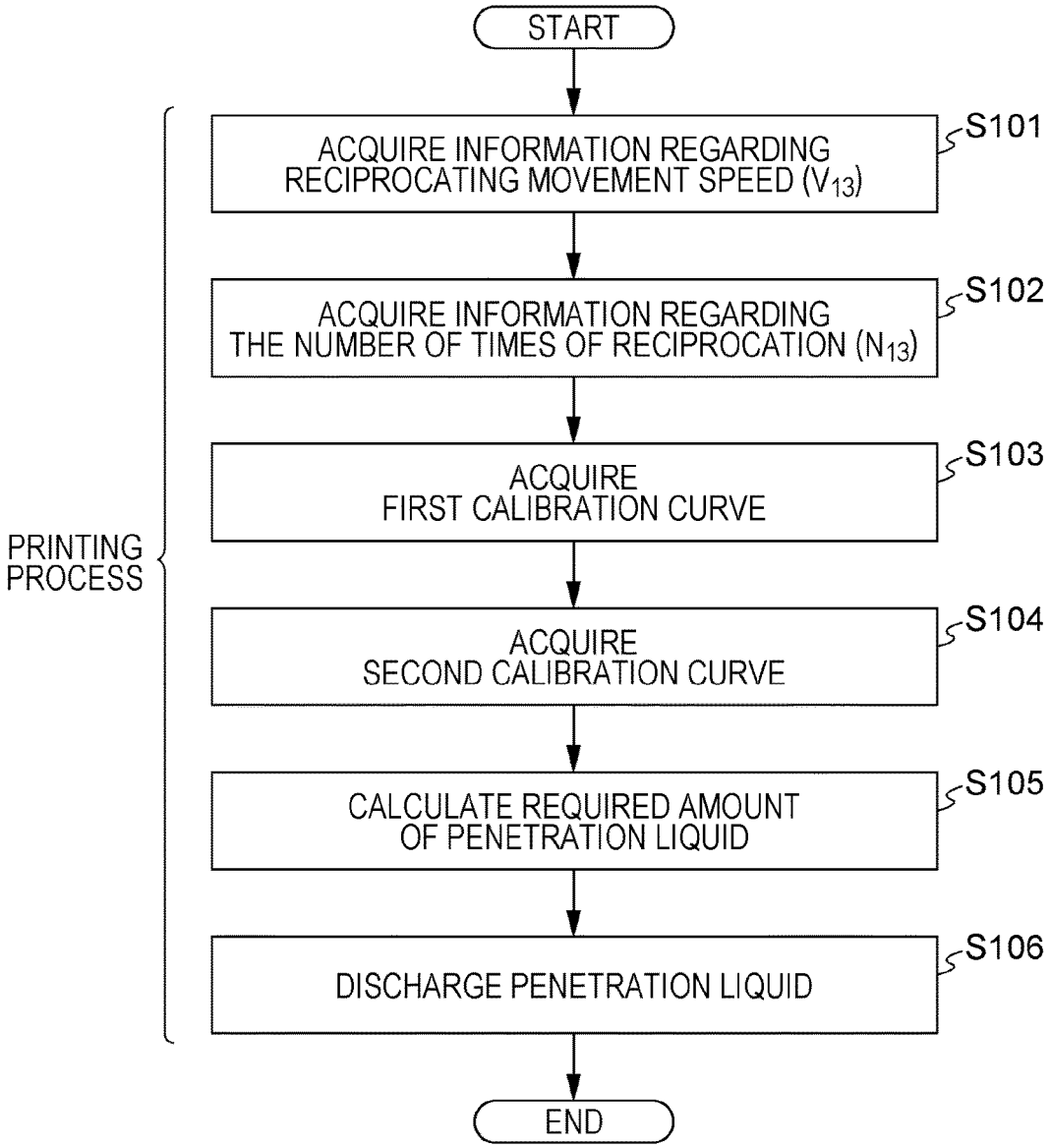
FIG. 5 is a flowchart illustrating a control program stored in the printing apparatus of FIG. 1.
Figure 6:
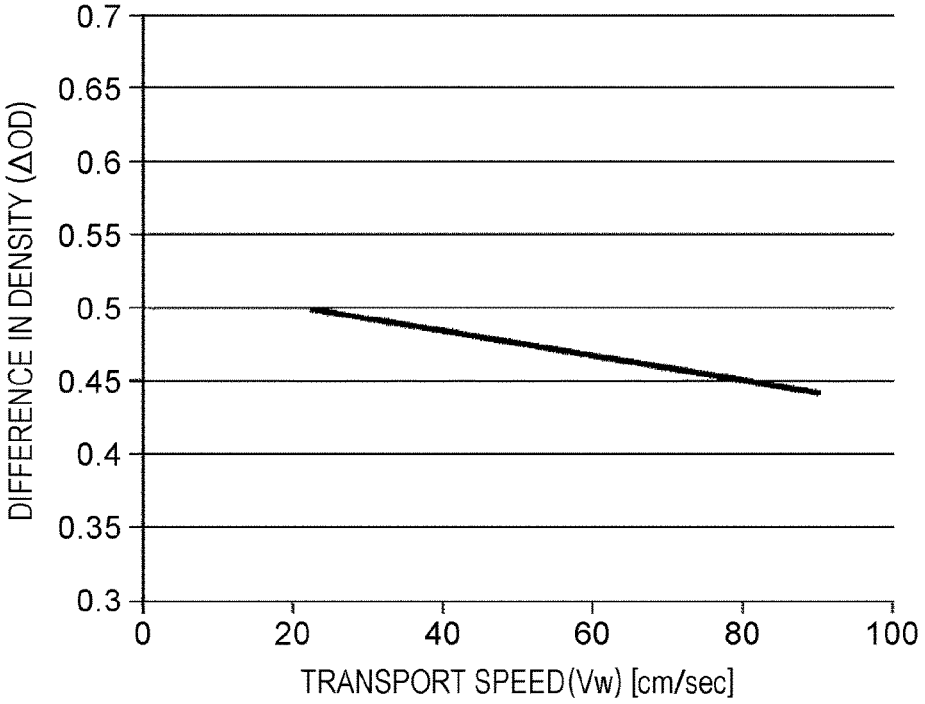
FIG. 6 is a first calibration curve stored in the printing apparatus of FIG. 1.
Figure 7:
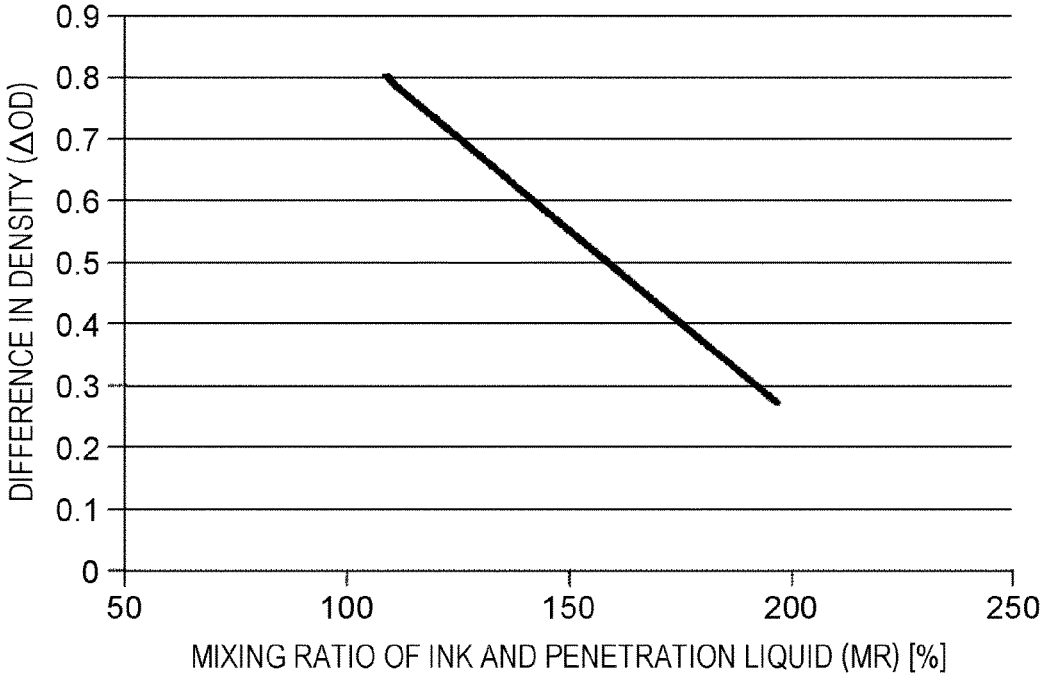
FIG. 7 is a second calibration curve stored in the printing apparatus of FIG. 1.
Figure 9:
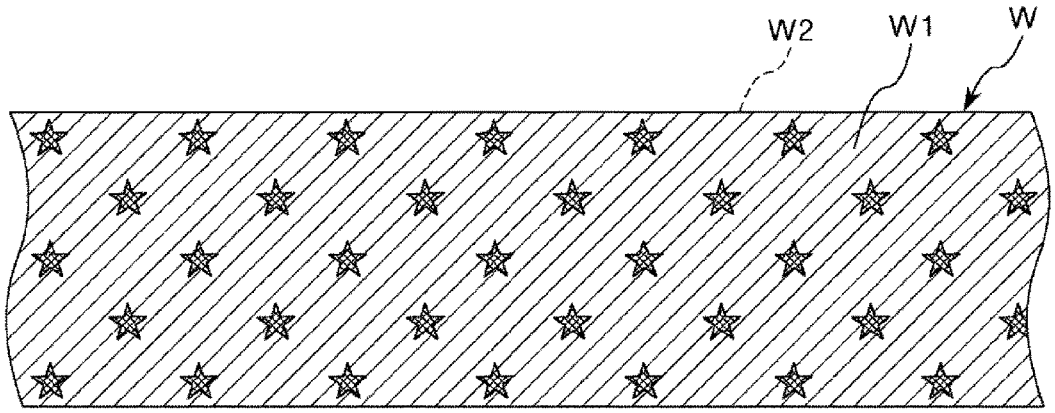
FIG. 9 is a view illustrating a front side of a medium on which printing has been performed by the printing apparatus of the embodiment.
Figure 10:
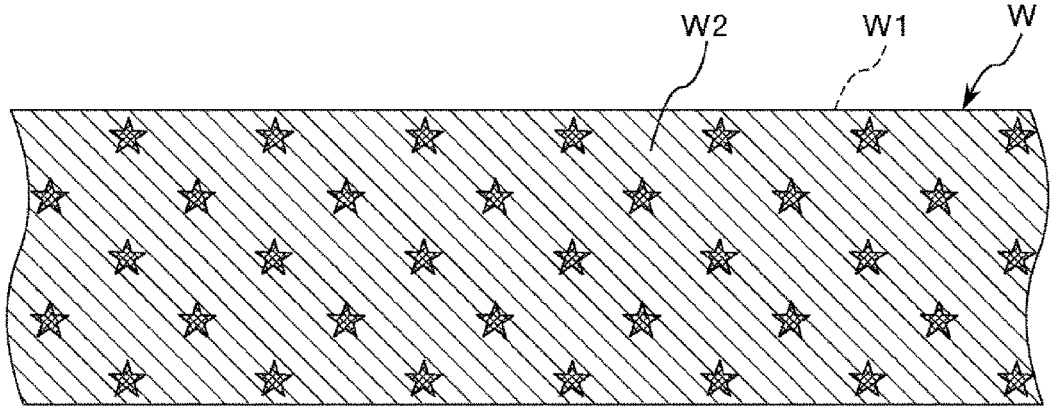
FIG. 10 is a view illustrating a back side of the medium of FIG. 9.

FIG. 1 is a side view schematically illustrating a printing apparatus of a first embodiment. FIG. 2 is a block diagram illustrating a main part of the printing apparatus of FIG. 1. FIG. 3 is a view illustrating an ink jet head of the printing apparatus of FIG. 1 seen from below. FIG. 4 is a vertical sectional view illustrating the ink jet head of the printing apparatus of FIG. 1. FIG. 5 is a flowchart illustrating a control program stored in the printing apparatus of FIG. 1. FIG. 6 is a first calibration curve stored in the printing apparatus of FIG. 1. FIG. 7 is a second calibration curve stored in the printing apparatus of FIG. 1. FIG. 9 is a view illustrating a front side of a medium on which printing has been performed by the printing apparatus of the embodiment. FIG. 10 is a view illustrating a back side of the medium of FIG. 9. Note that for the sake of description, hereinafter, the depth direction of the sheet of FIG. 1 is referred to as the "X direction", the left-right direction of the sheet of FIG. 1 is referred to as the "Y direction", and the up-down direction of the sheet of FIG. 1 is referred to as the "Z direction". Moreover, the direction in which each arrow is oriented is "positive", and the direction opposite to the "positive" direction is referred to as the "negative" direction. Moreover, each coordinate axis in FIG. 3 and FIG. 4 (as well as in FIG. 8) corresponds to the coordinate axes of FIG. 1.

A printing apparatus 1 according to an embodiment is a printing apparatus configured to perform printing on a medium W which is a sheet-like recording medium into which liquid can penetrate, and the printing apparatus 1 includes a printing unit 13 (discharge unit) configured to discharge, onto a front side W1 (one side) of the medium W (recording medium), ink IK and penetration liquid PL which promotes penetration of the ink IK into a back side W2 (the other side) of the medium W (recording medium); a movement unit 21 configured to move the printing unit 13 (discharge unit) and the medium W (recording medium) relative to each other when the printing is performed; and a CPU 151 configured to function as an adjustment unit which adjusts a discharge amount of the penetration liquid PL discharged from the printing unit 13 (discharge unit) onto the medium W (recording medium) on the basis of at least a relative movement speed of the printing unit 13 (discharge unit) to the medium W (recording medium).

Moreover, a printing method according to an embodiment includes performing printing on a medium W which is a sheet-like recording medium into which liquid can penetrate, wherein in performing the printing, the printing apparatus 1 is used, the printing apparatus including a printing unit 13 (discharge unit) configured to discharge, onto the front side W1 (one side) of the medium W (recording medium), ink IK and penetration liquid PL which promotes penetration of the ink IK into the back side W2 (the other side) of the medium W (recording medium); a movement unit 21 configured to move the printing unit 13 (discharge unit) and the medium W (recording medium) relative to each other when the printing is performed; and a CPU 151 configured to function as an adjustment unit which adjusts a discharge amount of the penetration liquid PL discharged from the printing unit 13 (discharge unit) onto the medium W (recording medium) on the basis of at least a relative movement speed of the printing unit 13 (discharge unit) to the medium W (recording medium).

The medium W on which the printing has been performed may be processed into, for example, a scarf, a neckerchief, a bandana, a handkerchief. Such processed products may be used in a reversible manner. Thus, according to the above-described embodiment, the discharge amount of the penetration liquid is adjusted as described later to enable the difference in density ΔOD between the front side W1 and the back side W2 of the medium W after the printing to be as small as possible. Thus, the medium W (processed product) processed into, for example, a scarf is usable in a reversible manner.

Configurations of each of the units will be described below.

The printing apparatus 1 is a textile printing apparatus configured to perform printing on a medium W as a recording medium having an elongated shape while transporting the medium W.

As illustrated in FIG. 1, the printing apparatus 1 includes a machine base 11, a transport unit 12 configured to transport the medium W, the printing unit 13 configured to perform printing by applying ink IK onto the medium W, a drying unit 16 configured to dry the ink IK on the medium W, and the control unit 15 configured to control operation of each of these units. Moreover, as illustrated in FIG. 2, the printing apparatus 1 further includes a reciprocating movement unit 14 configured to reciprocate the printing unit 13, a notification unit 17 configured to perform notification of various types of information, and an input operation unit 18 to and in which conditions for performing the printing are input and set. Moreover, the control unit 15 of the printing apparatus 1 is electrically connected to an external electric power source 200.

In the present embodiment, a direction orthogonal to a direction in which the medium W is transported is the X direction, a direction parallel to the transport direction is the Y direction, and a direction orthogonal to both the X direction and the Y direction is the Z direction.

The transport unit 12 includes a supply apparatus 3 configured to supply the medium W having an elongated shape and being rolled, a take-up apparatus 4 configured to take up the medium W after printing, and a support apparatus 5 disposed on the machine base 11 and configured to support the medium W during the printing.

The supply apparatus 3 is disposed upstream (on a negative side in the Y direction) of the machine base 11 in the transport direction (feeding direction) of the medium W. The supply apparatus 3 includes a roller (supply reel) 31 on which the medium W is rolled and which feeds the medium W and a tensioner 32 configured to apply tension to the medium W between the feeding roller 31 and the support apparatus 5. A motor (not shown) is connected to the feeding roller 31, and operation of the motor enables rotation of the feeding roller 31.

The medium W may be a textile material on which printing is to be performed. The textile material on which printing is to be performed is fabric or the like which is a print target. Examples of the fabric include woven fabric, knitted fabric, unwoven fabric, and the like of natural fiber such as cotton, silk, wool, and the like, chemical fiber such as nylon, or composite fiber obtained by mixing natural fiber and chemical fiber. An image of, for example, a figure or a pattern is printed on the medium W by the printing apparatus 1. The medium W on which the printing has been performed is processed into, for example, a scarf, a neckerchief, a bandana, a handkerchief. Note that the medium W has an elongated shape as described above, and preferably has a width of, for example, more than or equal to 100 mm and less than or equal to 2500 mm, more preferably more than or equal to 500 mm and less than or equal to 1800 mm. The medium W has a thickness of, for example, more than or equal to 0.1 mm and less than or equal to 5 mm, more preferably more than or equal to 0.1 mm and less than or equal to 2 mm. Moreover, regular paper, high-quality paper, glossy paper specifically for ink jet recording, and the like may be used as the medium W in addition to textile material.

The take-up apparatus 4 is disposed downstream (on a positive side in the Y direction) of the machine base 11 in the transport direction of the medium W with respect to the supply apparatus 3. The take-up apparatus 4 includes a take-up roller (take-up reel) 41 on which the medium W is rolled up and a tensioner 42, tensioner 43, and tensioner 44 which apply tension to the medium W between the take-up roller 41 and the support apparatus 5. A motor (not shown) is connected to the take-up roller 41, and operation of the motor enables rotation of the take-up roller 41. The tensioner 42, the tensioner 43, and the tensioner 44 are disposed in this order at intervals in a direction away from the take-up roller 41.

The support apparatus 5 is disposed between the supply apparatus 3 and the take-up apparatus 4. The support apparatus 5 includes a drive roller 51 and a driven roller 52 arranged apart from each other in the Y direction, an endless belt 53 which bridges the drive roller 51 and the driven roller 52, and a tensioner 54 and a tensioner 55 which apply tension to the medium W between the drive roller 51 and the driven roller 52.

A motor (not shown) is connected to the drive roller 51, and operation of the motor enables rotation of the drive roller 51. Moreover, a torque of the drive roller 51 is transferred to the driven roller 52 via the endless belt 53, and the driven roller 52 can turn in interlock with the drive roller 51.

The endless belt 53 is a glue belt having a front side surface provided with an adhesive layer having adhesion. A part of the medium W adheres to and is fixed to the adhesive layer and is transported to the positive side in the Y direction. During the transportation, printing is performed on the medium W. Moreover, after the printing, the medium W is peeled off from the endless belt 53.

Similarly to the drive roller 51 and the driven roller 52, the tensioner 54 and the tensioner 55 are also disposed apart from each other in the Y direction.

The tensioner 54 can pinch the medium W together with the endless belt 53 between itself and the drive roller 51, and the tensioner 55 can pinch the medium W together with the endless belt 53 between itself and the driven roller 52. Thus, the medium W to which tension is applied by the tensioner 54 and the tensioner 55 is fixed to and transported by the endless belt 53 with the tension being applied. In such a state, the medium W is prevented from, for example, wrinkling during the transportation, and thus, when printing is performed, the printing is accurate and has a high quality.

The printing unit 13 is a discharge unit which discharges the ink IK and the penetration liquid PL onto the front side W1 (one side) of the medium W (recording medium).

Note that the ink IK includes a pigment as a colorant contained and dispersed in water as a solvent, and in the present embodiment, four ink colors, black (K), cyan (C), magenta (M), and yellow (Y) are used. Thus, the printing apparatus 1 is capable of performing color printing. In the printing apparatus 1, the ink IK of each color is reserved and prepared in an ink cartridge 19 in advance. Moreover, each ink cartridge 19 is connected to the printing unit 13 via a pipe 191 in a liquid-tight manner.

The penetration liquid PL promotes penetration of the ink IK to the back side W2 (the other side) of the medium W. In this way, an image is formed not only on the front side W1 but also on the back side W2 of the medium W. There are no particular limitations to the penetration liquid PL, and it may be, for example, penetration liquid containing at least one type of liquid selected from an acetylene glycol-based surfactant and a polysiloxane-based surfactant. In the printing apparatus 1, the penetration liquid PL is reserved in advance and prepared in a penetration liquid cartridge 20. Moreover, the penetration liquid cartridge 20 is connected to the printing unit 13 via a pipe 201 in a liquid-tight manner.

The printing unit 13 includes a carriage unit 9 on which a plurality of liquid droplet discharge heads 92 are mounted. As illustrated in FIG. 3, in the present embodiment, five liquid droplet discharge heads 92 arranged in sequence along the X direction are mounted on the carriage unit 9. These five liquid droplet discharge heads 92 are a liquid droplet discharge head 92K, a liquid droplet discharge head 92C, a liquid droplet discharge head 92M, a liquid droplet discharge head 92Y, and a liquid droplet discharge head 92PL.

The liquid droplet discharge head 92K includes a plurality of nozzles 941 through which ink IK which is black (K) in color is discharged. These nozzles 941 are arranged at regular intervals along the Y direction, thereby forming a nozzle array 94K.

The liquid droplet discharge head 92C includes a plurality of nozzles 941 through which ink IK which is cyan (C) in color is discharged. These nozzles 941 are arranged at regular intervals along the Y direction, thereby forming a nozzle array 94C.

The liquid droplet discharge head 92M includes a plurality of nozzles 941 through which ink IK which is magenta (M) in color is discharged. These nozzles 941 are arranged at regular intervals along the Y direction, thereby forming a nozzle array 94M.

The liquid droplet discharge head 92Y includes a plurality of nozzles 941 through which ink IK which is yellow (Y) in color is discharged. These nozzles 941 are arranged at regular intervals along the Y direction, thereby forming a nozzle array 94Y.

The liquid droplet discharge head 92PL includes a plurality of nozzles 941 through which the penetration liquid PL is discharged as liquid droplets. These nozzles 941 are arranged at regular intervals along the Y direction, thereby forming a nozzle array 94PL.

Since the liquid droplet discharge head 92K, the liquid droplet discharge head 92C, the liquid droplet discharge head 92M, the liquid droplet discharge head 92Y, and the liquid droplet discharge head 92PL have the same configurations except for the liquid which is discharged, the configuration of the liquid droplet discharge head 92PL will be described below representatively.

As illustrated in FIG. 4, the liquid droplet discharge head 92PL includes a nozzle plate 961, a cavity substrate 962, a diaphragm 963, and a layered piezoelectric actuator 965 including a plurality of stacked piezoelectric elements 964*a*.

The nozzles 941 included in the nozzle array 94PL penetrate through the nozzle plate 961.

The cavity substrate 962 has a predetermined shape as shown in FIG. 4, thereby forming a cavity (pressure chamber) 966 and a reservoir 967 in communication with the cavity 966. The cavity 966 is filled with the penetration liquid PL, and vibration of the diaphragm 963 increases and reduces pressure in the cavity 966. Moreover, the reservoir 967 is connected to the penetration liquid cartridge 20 via the pipe 201.

The nozzles 941 included in the nozzle array 94PL penetrate through the nozzle plate 961. Each nozzle 941 is in communication with the cavity 966 and enables the penetration liquid PL to be discharged as liquid droplets by increasing and reducing the pressure in the cavity 966.

The piezoelectric actuator 965 vibrates the diaphragm 963. The piezoelectric actuator 965 includes comb-like first electrode 964*b* and second electrode 964*c* which are arranged to face each other and piezoelectric elements 964*a* arranged alternately with each comb tooth of the first electrode 964*b* and the second electrode 964*c*. Moreover, the piezoelectric actuator 965 has one end joined to the diaphragm 963 via an intermediate layer 969. The piezoelectric actuator 965 having such a configuration uses a mode in which expansion and contraction in the up-down direction in FIG. 4 is caused by a drive signal applied between the first electrode 964*b* and the second electrode 964*c* from a drive signal source. Since the piezoelectric actuator 965 includes the stacked piezoelectric elements 964*a*, relatively large driving force is obtained. When the drive signal is applied to the piezoelectric actuator 965, the diaphragm 963 vibrates. This changes the pressure in the cavity 966, and thus, liquid droplets of the penetration liquid PL are discharged from each nozzle 941.

In the printing apparatus 1, the printing unit 13 discharges the ink IK and the penetration liquid PL while intermittent feeding (subscanning) in the Y direction is performed in a fixed state where the medium W supplied from the supply apparatus 3 of the transport unit 12 is fixed by the endless belt 53 by adhesion and reciprocating (main scanning) of the printing unit 13 in the X direction is caused by the reciprocating movement unit 14 with respect to the medium W in the fixed state. This can be performed until the printing is completed, and an image is formed on the medium W.

The reciprocating movement unit 14 supports the printing unit 13 movably in a reciprocating manner along the X direction. In this way, the printing unit 13 can reciprocate across the medium W. Note that the reciprocating movement unit 14 preferably includes, for example, a ball screw and a linear guide.

In this way, in the printing apparatus 1, the transport unit 12 and the reciprocating movement unit 14 may be collectively referred to as the "movement unit 21" configured to move the printing unit 13 (discharge unit) and the medium W (recording medium) relative to each other when the printing is performed.

As described above, the medium W (recording medium) has an elongated shape. The movement unit 21 includes the transport unit 12 configured to transport the medium W (recording medium) in a longitudinal direction (Y direction) of the medium W (recording medium), and a reciprocating movement unit 14 configured to reciprocate the print unit 13 (discharge unit) in a direction (X direction) crossing the transport direction of the medium W (recording medium). This configuration enables stable and rapid printing on the medium W.

The drying unit 16 is disposed downstream of the printing unit 13 in the transport direction of the medium W and between the support apparatus 5 and the take-up roller 41 of the take-up apparatus 4. The drying unit 16 includes a chamber 161 in which a heater is built. In this way, when the medium W passes through the chamber 161, undried ink IK on the medium W can be dried by heat of the heater.

Note that the tensioner 42 and the tensioner 43 are arranged on both sides of the drying unit 16 in the Y direction. In this way, the medium W can pass through the chamber 161 under tension. In such a state, the medium W is prevented from, for example, wrinkling while passing through the chamber 162, and thus, the ink IK can be reliably dried.

The notification unit 17 includes, for example, a loudspeaker and/or a signal lamp. This enables notification of various types of information of the printing apparatus 1 by using sound and/or light.

The input operation unit 18 includes, for example, a touch panel. An operator who operates the printing apparatus 1 may input various types of conditions at the time of printing via the input operation unit 18. The conditions are not particularly limited, but are, for example, print programs. Note that the input operation unit 18 may also serve as the notification unit 17 which performs notification of the various types of information of the printing apparatus 1 by displaying the various types of information.

The control unit 15 is electrically connected to the transport unit 12, the printing unit 13, the reciprocating movement unit 14, the drying unit 16, the notification unit 17, and the input operation unit 18, and has a function of controlling operation of each of these units. As illustrated in FIG. 2, the control unit 15 includes a Central Processing Unit (CPU) 151 and a storage unit 152.

The CPU 151 executes a program for various types of processes including the printing process and the like as described above.

The storage unit 152 includes for example, Electrically Erasable Programmable Read-Only Memory (EEPROM), which is a type of nonvolatile semiconductor memory and can store the various types of programs and the like.

An external electric power source 200 which applies a voltage of, for example, 200 V is electrically connected to the control unit 15. In this way, electric power is supplied to each unit of the printing apparatus 1.

Here, as described above, the medium W on which the printing has been performed is processed into, for example, a scarf, a neckerchief, a bandana, a handkerchief. Such processed products may be used in a reversible manner. However, if the front side and the back side of the processed product are different in density, it may become difficult to use the processed product in a reversible manner. For example, when the medium W before the printing is white in color, the back side of the medium W after the printing generally looks more whitish than the front side. Moreover, a feeling of luxury is lost and the processed product looks cheap depending on the types of the processed product. One of causes of the occurrence of the difference in density is insufficient penetration of the ink IK into the back side of the medium W depending on the print conditions even when the penetration liquid PL is used.

Thus, the printing apparatus 1 is configured to be able to prevent such a trouble. The operation of the configuration will be described below.

The printing apparatus 1 is configured to adjust the discharge amount of the penetration liquid PL discharged from the printing unit 13 (discharge unit) onto the medium W (recording medium) on the basis of at least a relative movement speed of the printing unit 13 (discharge unit) to the medium W (recording medium). The CPU 151 is responsible for this adjustment. Thus, it can be said that the CPU 151 has a function as an "adjustment unit" for performing the adjustment.

In the printing apparatus 1, the movement unit 21 including the transport unit 12 and the reciprocating movement unit 14 enables relative movement of the printing unit 13 (discharge unit) and the medium W (recording medium) when the printing is performed. The "relative movement speed" includes a transport speed $V_W$ at which the medium W is transported in the Y direction with respect to the printing unit 13 and a reciprocating movement speed $V_{13}$ at which the printing unit 13 reciprocates in the X direction with respect to the medium W. Further, the later-described "time to completion of the printing entirely (impact time difference)" and the like with respect to the medium W is included.

Moreover, the storage unit 152 stores the first calibration curve of FIG. 6 and the second calibration curve of FIG. 7 in advance. "The first calibration curve" is a graph representing the relationship between the transport speed $V_W$ and the difference in density ΔOD between the front side W1 (one side) of the medium W (recording medium) on which the printing has been performed and the back side W2 (the other side). The first calibration curve is, for example, experimentally obtained for each color of the ink IK, and "(difference in density ΔOD)=|(density of front side W1)−(density of back side W2)|". "The second calibration curve" is a graph showing the relationship of a mixing ratio MR of the ink IK and the penetration liquid PL when printing was performed and the difference in density ΔOD. The second calibration curve is also obtained, for example, experimentally for each color of the ink IK. In the present embodiment, for example, the mixing ratio MR of 100% means that the ink IK corresponds to 100% and the penetration liquid PL corresponds to 0%, the mixing ratio MR of 150% means that the ink IK corresponds to 100% and the penetration liquid PL corresponds to 50%, and the mixing ratio MR of 200% means that the ink IK corresponds to 100% and the penetration liquid PL corresponds to 100%. The mixing ratio is determined on the basis of weight (wt %).

The CPU 151 (adjustment unit) adjusts the discharge amount of the penetration liquid PL on the basis of the transport speed $V_W$ at which the medium W (recording medium) is transported. The inventors found a certain relationship (see FIG. 6) between the transport speed $V_W$ and the difference in density ΔOD and also found a certain relationship (see FIG. 7) between the mixing ratio MR and the difference in density ΔOD.

As described above, the printing apparatus 1 includes the storage unit 152 configured to store the transport speed $V_W$, the first calibration curve showing the relationship between the transport speed $V_W$ and the difference in density ΔOD between the front side W1 (one side) and the back side W2 (the other side) of the medium W (recording medium) on which the printing has been performed, the second calibration curve showing the relationship of the transport speed $V_W$ and the mixing ratio MR of the ink IK and the penetration liquid PL when the printing was performed, and the difference in density ΔOD. The CPU 151 (adjustment unit) may use the first calibration curve and the second calibration curve to adjust the discharge amount of the penetration liquid PL since together the first and second calibration curves provide a relationship between the transport speed Vw and the mixing ratio MR.

Moreover, the CPU 151 (adjustment unit) adjusts the discharge amount of the penetration liquid PL on the basis of the reciprocating movement speed $V_{13}$ at which the printing unit 13 (discharge unit) reciprocates. The reciprocating movement speed $V_{13}$ can be equated with the transport speed Vw.

As described above, on the medium W (recording medium), an image, for example, a figure or a pattern is to be formed by printing. Then, the CPU 151 (adjustment unit) further adjusts the discharge amount of the penetration liquid PL on the basis of the number of times of reciprocation $N_{13}$ of the printing unit 13 (discharge unit) required to form the image, that is, required from a start of formation of the image to a completion of the formation of the image.

As described above, in the present embodiment, the CPU 151 adjusts the discharge amount of the penetration liquid PL on the basis of three print conditions, that is, the transport speed $V_W$, the reciprocating movement speed $V_{13}$, and the number of times of reciprocation $N_{13}$. Such adjustment enables, as described later, the difference in density ΔOD between the front side W1 and the back side W2 of a sheet-like medium W after the printing to be as small as possible. Thus, the medium W after the printing can be used in a reversible manner.

Next, a control program for adjusting the discharge amount of the penetration liquid PL will be described with reference to the flowchart of FIG. 5. Note that the printing method according to the embodiment includes a print step of performing printing on the medium W by using the printing apparatus 1, wherein the print step includes steps S101 to S106 (see FIG. 5).

First, information regarding the reciprocating movement speed $V_{13}$, which is one of the three print conditions required to perform prescribed printing on the medium W, is acquired (step S101).

Next, information regarding the number of times of reciprocation $N_{13}$ is acquired (step S102).

Next, from the storage unit 152, the first calibration curve is retrieved and the first calibration curve is acquired (step S103), and the second calibration curve is retrieved and the second calibration curve is acquired (step S104).

Next, the discharge amount of the penetration liquid PL which is required for printing this time, that is, which is enough to enable the difference in density ΔOD to be as small as possible is calculated from the reciprocating movement speed $V_{13}$ acquired in step S101, the number of times of reciprocation $N_{13}$ acquired in step S102, the first calibration curve acquired in step S103, and the second calibration curve acquired in step S104 (step S105).

Next, the penetration liquid PL is discharged at the discharge amount calculated in step S105 (step S106).

Here, specific examples will be described.

The ink IK used is cyan (C) ink IK. Moreover, the center distance (X direction) between the nozzle array 94C configured to discharge the cyan (C) ink IK and the nozzle array 94PL configured to discharge the penetration liquid PL was 133 [mm].

Table shows an initial setting as an example.

TABLE

| | |
|---|---|
| Print Width (X Direction) [mm] | 1800 |
| Reciprocating Movement Speed $V_{13}$ [cm/sec] | 255 |
| The Number of Times of Reciprocation $N_{13}$ [times] | 0.5 |
| Mixing Ratio MR [%] | 230 |
| Gradient of First Calibration Curve | −0.067 |
| Gradient of Second Calibration Curve | −153.97 |

To perform printing on the medium W, as new print conditions for the printing, the reciprocating movement speed $V_{13}$ was 500 [cm/sec], and the number of times of reciprocation $N_{13}$ was 1 (time). Each type of information is acquired in step S101 to step S104.

The following calculation is performed in step S105 by the CPU 151.

In the initial setting, a time until the ink IK and the penetration liquid PL are mixed (overlapped each other) on the medium W is 0.21 [sec].

On the other hand, under the new print condition, a time until the ink IK and the penetration liquid PL are mixed (overlapped each other) on the medium W is 0.11 [sec]. Moreover, under the new print condition, printing over a print width of 1800 [mm] is performed by a number of times of reciprocation $N_{13}$=1 (time), and therefore, a print time of 1.44 sec is added, and a time until the entire printing is completed is as follows: 0.11 [sec]+1.44 [sec]=1.55 [sec]. Thus, the time difference from the initial setting is as follows: 1.55 [sec]−0.21 [sec]=1.34 [sec]. Thus, a resultant change of the difference in density ΔOD is 1.34× (inclination of first calibration curve (−0.067))=−0.09, and the mixing ratio MR required under the new print condition is −0.09× (inclination of second calibration curve (−153.97))+mixing ratio MR (230[%] in initial setting) ≃ 244[%]. As described above, it can be said that one of the important factors to reduce as much as possible the difference in density between one side and the other side of the medium W is the time difference (impact time difference) between 1) a time until the ink IK and the penetration liquid PL are mixed (overlapped) on the medium W and the entire printing is completed in the initial setting and 2) a time until the ink IK and the penetration liquid PL are mixed (overlapped) on the medium W and the entire printing is completed under the new print condition.

In step S106, it is possible to discharge the ink IK and the penetration liquid PL to achieve a mixing ratio MR of 244[%]. Such discharge enables the difference in density ΔOD between the front side W1 and the back side W2 of a sheet-like medium W after printing to be as small as possible (see FIGS. 9 and 10). After the medium W is processed into, for example, a scarf, a neckerchief, a bandana, a handkerchief, the medium W can be used in a reversible manner.

Moreover, according to the control as described above, the difference in density ΔOD of the medium W after the printing is as small as possible even when the reciprocating movement speed $V_{13}$ and the number of times of reciprocation $N_{13}$ are accordingly changed.

In an aspect in which the printing unit 13 adjusts the discharge amount of the penetration liquid PL, the CPU 151 (adjustment unit) changes the number of liquid droplets of the penetration liquid PL per unit area of the medium W (recording medium) or the volume per liquid droplet of the penetration liquid PL, thereby adjusting the discharge amount of the penetration liquid PL to achieve the desired mixing ratio of ink and penetration liquid.

As described above, the liquid droplet discharge head 92PL of the printing unit 13 (discharge unit) includes the diaphragm 963, the cavity 966 filled with the penetration liquid and having pressure which is increased and reduced by vibration of the diaphragm 963, and the nozzle 941 which is in connection with the cavity 966 and through which the penetration liquid PL is discharged as liquid droplets through an increase and a decrease in the pressure. The CPU 151 (the adjustment unit) changes the oscillation frequency of the diaphragm 963 to vary the number of the liquid droplets of the penetration liquid PL, and the CPU 151 changes the amplitude of the diaphragm 963 to vary the volume per liquid droplet of the penetration liquid PL. As illustrated in FIG. 4, in the present embodiment, the CPU 151 has the former aspect, that is, the aspect in which the number of liquid droplets of the penetration liquid PL is changed (increased and reduced). With this configuration, a simple configuration that the oscillation frequency of the diaphragm 963 is varied enables easy adjustment of the discharge amount of the penetration liquid PL.

Second Embodiment

Figure 8:
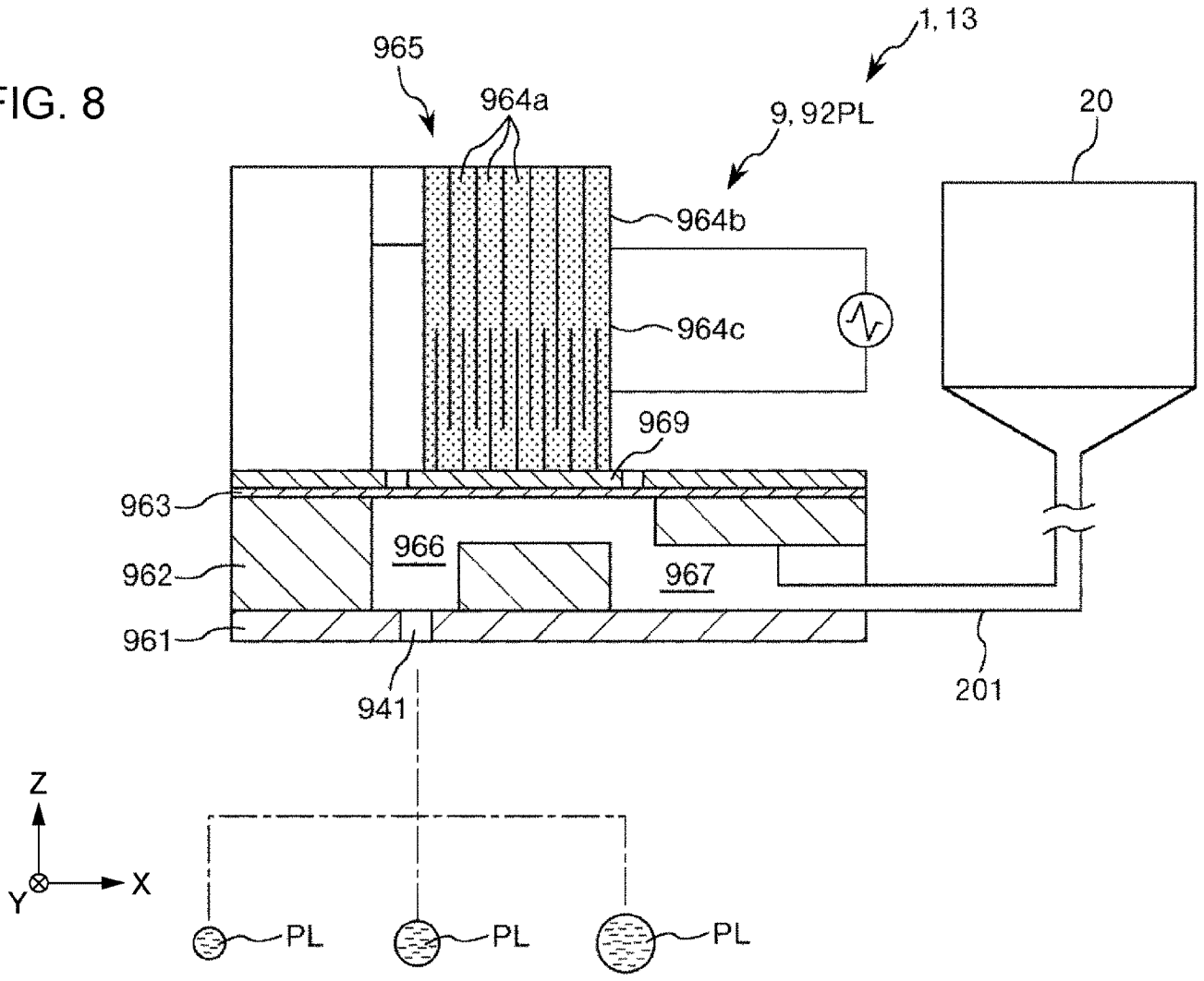
FIG. 8 is a vertical sectional view illustrating an ink jet head of a printing apparatus of a second embodiment.

FIG. 8 is a vertical sectional view illustrating an ink jet head of a printing apparatus of a second embodiment.

With reference FIG. 8, the printing apparatus and a printing method of the second embodiment will be described below, wherein the differences from the previously described embodiment will be mainly described, and the description of components similar to the previously described embodiment will be omitted.

The present embodiment is similar to the first embodiment except that an aspect of adjusting the discharge amount of the penetration liquid is different.

As also described in the first embodiment, in an aspect in which the printing unit 13 adjusts the discharge amount of the penetration liquid PL, the CPU 151 (adjustment unit) changes the number of liquid droplets of the penetration liquid PL per unit area of the medium W (recording medium) or the volume per liquid droplet of the penetration liquid PL, thereby adjusting the discharge amount of the penetration liquid.

Moreover, the liquid droplet discharge head 92PL of the printing unit 13 (discharge unit) includes the diaphragm 963, the cavity 966 which is filled with the penetration liquid and in which pressure is increased and reduced by vibration of the diaphragm 963, the nozzle 941 which is in connection with the cavity 966 and through which the penetration liquid PL is discharged as liquid droplets through an increase and a decrease in the pressure. The CPU 151 (the adjustment unit) changes the oscillation frequency of the diaphragm 963 to vary the number of the liquid droplets of the penetration liquid PL, and the CPU 151 changes the amplitude of the diaphragm 963 to vary the volume per liquid droplet of the penetration liquid PL. As illustrated in FIG. 8, in the present embodiment, the CPU 151 has the latter aspect, that is, the aspect in which the volume per liquid droplet of the penetration liquid PL is changed (increased and reduced). With this configuration, a simple configuration that the amplitude of the diaphragm 963 is varied enables easy adjustment of the discharge amount of the penetration liquid PL.

Note that in the configuration shown in FIG. 8, the liquid droplets of the penetration liquid PL may have three sizes, large, medium, and small sizes from the light in the figure. The volume of the liquid droplet of the penetration liquid PL in the case of the size being "large" is preferably larger than or equal to 10 pL and smaller than or equal to 20 pL, more preferably larger than or equal to 13 pL and smaller than or equal to 17 pL. The volume of the liquid droplet of the penetration liquid PL in the case of the size being "medium" is preferably larger than or equal to 5 pL and smaller than or equal to 15 pL, more preferably larger than or equal to 8 pL and smaller than or equal to 12 pL. The volume of the liquid droplet of the penetration liquid PL in the case of the size being "small" is preferably larger than or equal to 1 pL and smaller than or equal to 10 pL, more preferably larger than or equal to 3 pL and smaller than or equal to 7 pL.

The printing apparatus and the printing method have been described above with reference to the embodiments shown in the drawings, but the invention is not limited to these embodiments. Moreover, each unit included in the printing apparatus may be replaced with any unit having a configuration to be able to provide a similar function. Moreover, any components may be added.

Moreover, the printing apparatus and the printing method may be a combination of any two or more configurations (features) of each of the embodiments.

Moreover, when adjustment of the discharge amount of the penetration liquid is performed, the oscillation frequency of the diaphragm of the discharge unit is changed or the amplitude of the diaphragm of the discharge unit is changed to perform the adjustment by means of hardware (mechanically), but the method of the adjustment is not limited to the method by means of hardware. For example, the adjustment of the discharge amount of the penetration liquid may be performed by a control unit, that is, in a control program by means of software.

Moreover, the printing apparatus uses four colors of ink in each of the embodiments, but the colors are not limited to those in the embodiments, and may be, for example, two, three, or five colors may be used.

Moreover, the transport unit includes an endless belt for fixing a medium by adhesion in each of the embodiments but is not limited to these embodiments. The transport unit may include a platen (stage) on which a medium is to be fixed, for example, by suction.

Moreover, in the printing apparatus of each of the embodiments, the printing unit reciprocates in the X direction, but the printing unit is not limited to these embodiments, and, for example, the movement of the printing unit may be restricted, that is, the printing unit may be fixed. In this case, the printing unit preferably has such a size that enables ink and penetration liquid to be sufficiently discharged onto the medium regardless of the width of the medium.

Moreover, the first calibration curve and the second calibration curve are obtained for each color of ink and are preferably obtained further for each type of media.

Moreover, the mixing ratio of the second calibration curve is a value obtained by varying the amount of the penetration liquid with the amount of ink in each embodiment being fixed, but the mixing ratio is not limited to this value and may be a value obtained by varying, for example, the amount of ink instead or as well. In other words, instead of changing only the amount of penetration liquid, it is possible to adjust the amount of ink as well or instead.

This application claims priority under 35 U.S.C. § 119 to Japanese Patent Application No. 2016-216697, filed Nov. 4, 2016. The entire disclosure of Japanese Patent Application No. 2016-216697 is hereby incorporated herein by reference.

What is claimed is:

1. A printing apparatus configured to perform printing on a sheet-like recording medium into which liquid can penetrate, the printing apparatus comprising:

a discharge unit configured to discharge, onto one side of the recording medium, ink and penetration liquid, the penetration liquid promoting penetration of the ink through the recording medium to the other side of the recording medium;

a movement unit configured to move the discharge unit and the recording medium relative to each other when the printing is performed;

an adjustment unit configured to adjust a discharge amount of the penetration liquid discharged from the discharge unit onto the recording medium on the basis of at least a relative movement speed of the discharge unit to the recording medium; and a storage unit configured to store:

a first calibration curve representing a relationship between a transport speed and a difference in density between one side and the other side of the recording medium on which the printing has been performed and a second calibration curve representing a relationship of a mixing ratio of the ink and the penetration liquid when the printing was performed and the difference in density, wherein the adjustment unit adjusts the discharge amount of the penetration liquid by using the first calibration curve and the second calibration curve.

2. The printing apparatus according to claim 1, wherein the recording medium has an elongated shape, and the movement unit includes a transport unit configured to transport the recording medium in a longitudinal direction of the recording medium and a reciprocating movement unit configured to reciprocate the discharge unit in a direction crossing the direction in which the recording medium is transported.

3. The printing apparatus according to claim 2, wherein the adjustment unit adjusts the discharge amount of the penetration liquid on the basis of the transport speed at which the recording medium is transported.

4. The printing apparatus according to claim 2, wherein the adjustment unit adjusts the discharge amount of the penetration liquid on the basis of a reciprocating movement speed at which the discharge unit reciprocates.

5. The printing apparatus according to claim 2, wherein the recording medium is a medium on which an image is formed by the printing, and the adjustment unit adjusts the discharge amount of the penetration liquid on the basis of a number of reciprocations by the discharge unit required to form the image.

6. The printing apparatus according to claim 1, wherein to adjust the discharge amount of the penetration liquid, the adjustment unit changes one of:

the number of liquid droplets of the penetration liquid per unit area of the recording medium, and a volume per liquid droplet of the penetration liquid.

7. The printing apparatus according to claim 6, wherein the discharge unit includes a diaphragm, a cavity which is filled with the penetration liquid and in which pressure is increased and reduced by vibration of the diaphragm, and a nozzle which is in communication with the cavity and through which the penetration liquid is discharged as liquid droplets by an increase and a decrease in the pressure in the cavity, and the adjustment unit changes, to vary the volume per liquid droplet of the penetration liquid, one of:

the oscillation frequency of the diaphragm, and the amplitude of the diaphragm.

8. A method of printing on a sheet-like recording medium into which liquid can penetrate, the method comprising:

discharging from ink and penetration ink from a discharge unit onto one side of the recording medium, the penetration liquid promoting penetration of the ink through the recording medium to the other side of the recording medium;

moving the discharge unit and the recording medium relative to each other when the printing; and adjusting a discharge amount of the penetration liquid discharged from the discharge unit onto the recording medium on the basis of at least a relative movement speed of the discharge unit to the recording medium, wherein a first calibration curve representing a relationship between the transport speed and a difference in density between one side and the other side of the recording medium on which the printing has been performed and a second calibration curve representing a relationship of a mixing ratio of the ink and the penetration liquid when the printing was performed and the difference in density is used to adjust the discharge amount of the penetration liquid.

* * * * *